United States Patent [19]

Kim et al.

[11] Patent Number: 4,744,412

[45] Date of Patent: May 17, 1988

[54] DOUBLE-WALL TUBE HEAT EXCHANGER

[75] Inventors: Sung C. Kim, Des Plaines; Marvin P. Schwartz, Arlington Heights; Howard Y. Yoon, Des Plaines, all of Ill.

[73] Assignee: ITT Corporation, New York, N.Y.

[21] Appl. No.: 914,105

[22] Filed: Oct. 1, 1986

[51] Int. Cl.[4] ..... F28F 9/16

[52] U.S. Cl. ..... 165/70; 165/133; 138/148

[58] Field of Search ..... 165/70, 133; 138/148

[56] References Cited

U.S. PATENT DOCUMENTS 4,635,711 1/1987 Clark, Jr. ..... 165/70

FOREIGN PATENT DOCUMENTS 703081 1/1954 United Kingdom ..... 165/70
730284 5/1955 United Kingdom ..... 165/70
960628 6/1964 United Kingdom ..... 165/70

*Primary Examiner*—Albert W. Davis, Jr.
*Attorney, Agent, or Firm*—Menotti J. Lombardi

[57] ABSTRACT

A heat exchanger utilizes a double walled heat transfer tube wherein the inner tube has a knurled external surface engaging the inner surface of an outer tube to provide multiple interconnected leak paths. The inner and outer tubes are attached to inner and outer tube sheets by roller expansion.

4 Claims, 2 Drawing Sheets

DOUBLE-WALL TUBE HEAT EXCHANGER

BACKGROUND OF THE INVENTION

This invention pertains to heat transfer tubes, a method of making heat transfer tubes, and heat exchangers employing same. In particular this invention pertains to double-walled heat transfer tubes and heat exchangers employing them.

One requirement for heat exchangers when a non-potable liquid is used as the transfer medium between a heat source and a water supply is that a minimum of two walls or interfaces be provided between the non potable liquid and the potable water supply.

Our prior U.S. Pat. Nos. 4,348,794 and 4,232,735 teach a double walled heat transfer tube having an externally finned outer tube. The inner and outer tubes are crimped together in such a way that leakage channels are provided between the inner and outer tubes.

Such finned heat transfer tube structures are particularly useful where one of the fluids has poor heat transfer characteristics.

However where the fluids have good heat transfer characteristics finned surfaces are of less advantage and where both fluids have excellent heat transfer characteristics, using fins on one of the tubes of the double wall construction would require that the transfer capabilities of the other tube also be increased.

Finned tubes have more tendency to foul where water or steam is used as one or both of the fluids because minerals in the water precipitate in the form of lime, seale, etc. The deposits collect on the fins and the ability of the unit to transfer heat is reduced. Where the tubes are mounted vertically, fluids will not freely drain on the outside finned surface thereby increasing the probability of fouling.

In one commercially available double wall heat transfer tube available from Wieland-America, Inc. the outer tube is integrally finned. The exterior surface of the inner tube is knurled. The knurling being relatively shallow and is provided to enhance the surface contact between the tubes but not to provide leak paths. The knurling extends all the way to both ends of the tube. The heat-transfer tube is utilized in single tube helical coil heat exchangers.

Such a heat transfer tube is not suitable for use in a multi-tube or shell end type heat exchanger utilizing either airpin "u" type tubes or straight tubes.

SUMMARY OF THE INVENTION

One object of the invention is to provide new and improved double-walled heat transfer tubes for use in heat exchangers.

Another object of the invention is to provide new and improved heat exchangers of the multi-tube or shell end type.

A further object is to provide new and improved methods for producing double-walled heat transfer tubes and heat exchangers using them.

In accordance with the principles of the invention, a double walled heat transfer tube has an outer tube which has substantially smooth interior and exterior walls and an inner tube which has a diamond knurled exterior surface. Further in accordance with the principles of the invention the knurling provides multiple interconnected leak paths in the double walled heat transfer tube.

Still further in accordance with the invention, the knurling is of such depth that the outer tube may be roller expanded into a tube sheet and still provide a positive leak path. The ends of the inner tube do not have knurling so that the inner tube can be expanded into a second tube sheet to provide a tight, leak proof connection.

BRIEF DESCRIPTION OF THE DRAWING

The invention will be better understood from a reading of the following detailed description in conjunction with the drawing in which.

DETAILED DESCRIPTION

Figure 1:
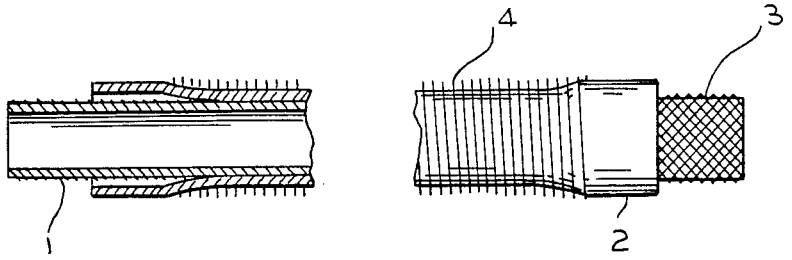
FIG. 1 (PRIOR ART)
FIG. 1 illustrates a prior art double walled heat transfer tube.

The prior art heat transfer tube of FIG. 1 includes copper alloy inner tube 1 and a copper alloy outer tube 2. The inner tube has its outer surface 3 knurled in a diamond knurl pattern. The outer tube 2 is placed over the inner tube and subjected to a finning operation which produces upstanding fins 4 extending perpendicularly outward from the outer surface of outer tube 2 in a thread like arrangement around the circumference of the tube 2. Simultaneous with forming of the fins 4, the outer tube 2 is compressed to a reduced inside diameter such that the inner surface of the tube 2 engages the outer surface of inner tube 1. By providing a knurled surface an enhanced surface is provided for contact with the inner surface of outer tube 2.

Figure 2:
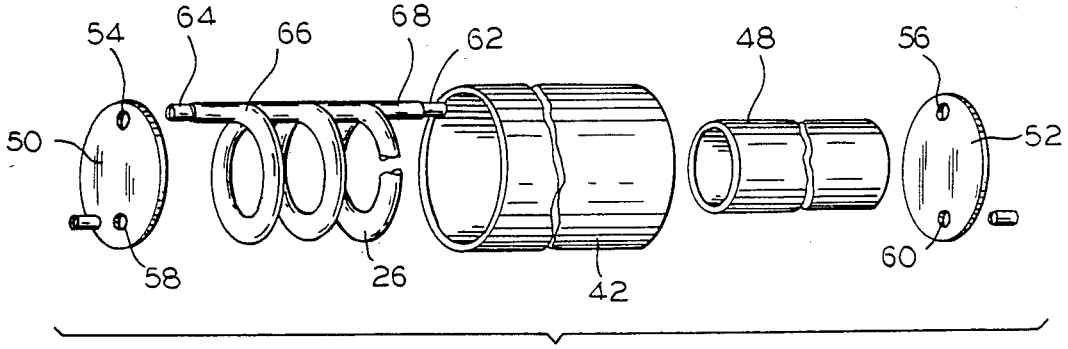
FIG. 2 (PRIOR ART)
FIG. 2 illustrates a prior art heat exchanger of the single coil variety in exploded perspective view.
Figure 3:
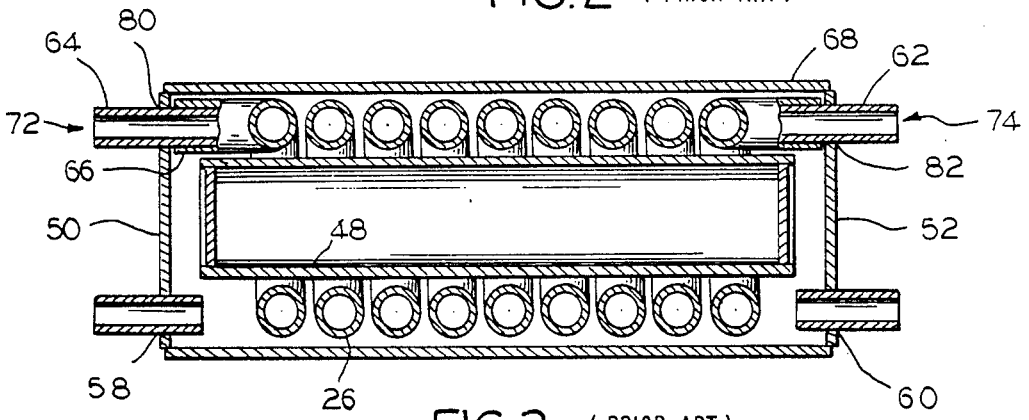
FIG. 3 (PRIOR ART)
FIG. 3 illustrate the heat-exchanger of FIG. 2 in partial cross section.

The heat transfer tube of FIG. 1 is readily used in a heat exchanger of the single tube helical coil type such as that shown in exploded perspective in FIG. 2 and in partial cross-section in FIG. 3. A heat transfer tube 26 corresponding to the above described tube 26 is coiled about an inner baffle 48 and positioned within the shell 42. End plates 50 and 52 are secured to the outer shell 42 by welding or brazing. Each end plate 50, 52 includes an aperture 54 and 56 through which the end portions of the tube 76 extend. Two ports are 58 and 60 provided in the end plates. Ports 58 and 60 are, respectively, the inlet and outlet ports for the fluid flowing within the shell 42 external to the tube 26. End portions 62 and 64 of the inner tube extend through the end plates 50 and 52 to serve as inlet and outlet ports 72 and 74, respectively, for the fluid flowing within the tube 26. End portions 66 and 68 of the outer tube 20 extend beyond the end plates 50 and 52, respectively, to provide ports 80 and 82 for the leakage paths formed between the inner and outer tubes 40 and 20, respectively.

In operation, fluids are individually introduced into the that exchanger through inlet ports 60 and 72 by suitable means such as compressors, pumps, and the like not shown. One fluid enters port 72, then circulates through the inner tube 40 of the heat transfer tube 26 and is evacuated therefrom through outlet port 74. The other fluid enters the port 58 and flows between the inner baffle 48 and the inner wall of the shell 42. This other fluid comes into contact with the externally finned surface of tube 26. The fluid continues to flow through the heat exchanger being exposed to heat transfer effects throughout the flow path. Eventually, the fluid reaches outlet port 60 where it is forced out of the unit.

Figure 4:
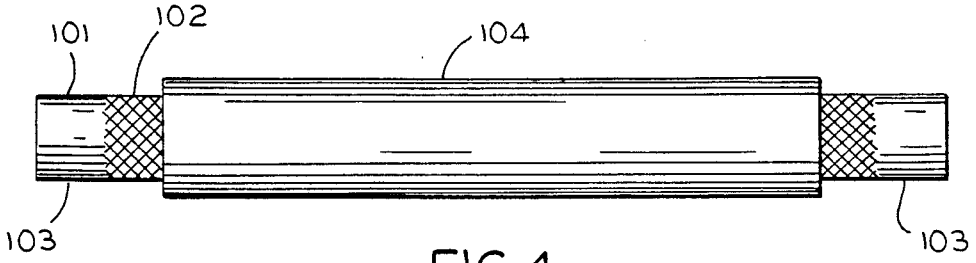
FIG. 4 illustrates a double walled heat transfer tube in accordance with the invention.

Turning now to FIG. 4, a heat transfer tube in accordance with the invention is shown.

The heat transfer tube is formed from an inner tube 101 which for example may be copper ASME SB-75, C12200 and has a $\frac{5}{8}$ inch o.d.×0.028 inch minimum wall. Inner tube 101 has an exterior knurled surface 102 and unknurled or plain ends 103 extending $\frac{5}{8}$ inch. The knurling is male diamond knurling at a 30 degree helix angle, 12 teeth per inch with 0.0833 inch circular pitch and 0.014 inch to 0.020 inch tooth depth.

It should be noted that the plain end portions 103 of the inner tube may be formed by marking off the knurling from the ends of a tube which is knurled from end to end.

An outer tube 104 is placed over inner tube 101. The outer tube 104 is also formed of copper ASME SB-75, C12200 and has a $\frac{3}{4}$ inch o.d.

Using well known techniques, the inner tube 101 and outer tube 104 are forced into contact with each other. Because of the knurling, multiple interconnected leak paths are formed between the tubes.

Figure 5:
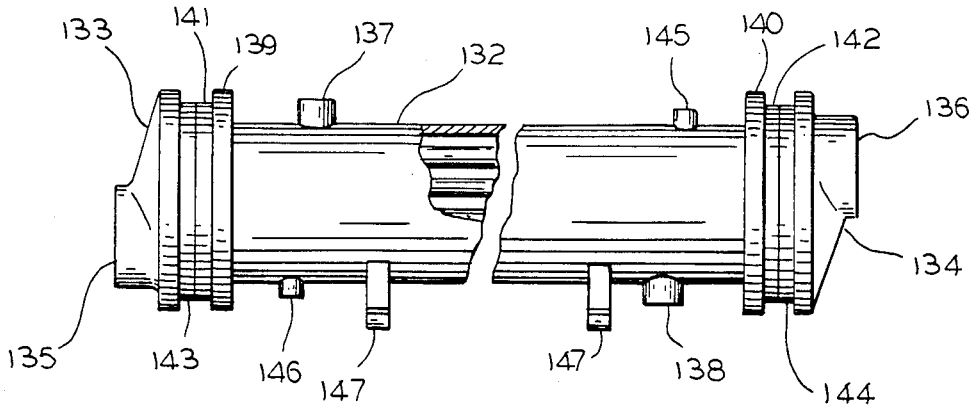
FIG. 5 illustrates a first heat exchanger in accordance with the invention.

Turning now to FIG. 5 a heat exchanger of the straight tube-fixed tube sheet-bonnet head design is shown which utilizes heat transfer tubes as described above. The heat exchanger has an outer shell 132. A plurality of heat transfer tubes are positioned within the shell 132. At each end of the heat exchanger a flanged bonnet head 133 or 134 is provided. An inlet 135 is provided in bonnet head 133 and an outlet 136 is provided in bonnet head 134. Inlet 135 and outlet 136 are provided for fluid flowing through the heat transfer tubes. Ports 137 and 138 are provided for fluid flowing outside the heat transfer tubes.

At each end of shell 132 is a flange 139, 140. Flanges 139 and 140 are utilized as tube sheets. Adjacent flanges 139 and 140 are spacers 141, 142. Adjacent the spacers are tube sheets 143, 144.

Additionally the heat exchanger includes a relief valve 145, a drain valve 146 and support legs 147.

The operation of this heat exchanger is substantially identical to those commerically available fro ITT Bell & Gossett.

Figure 6:
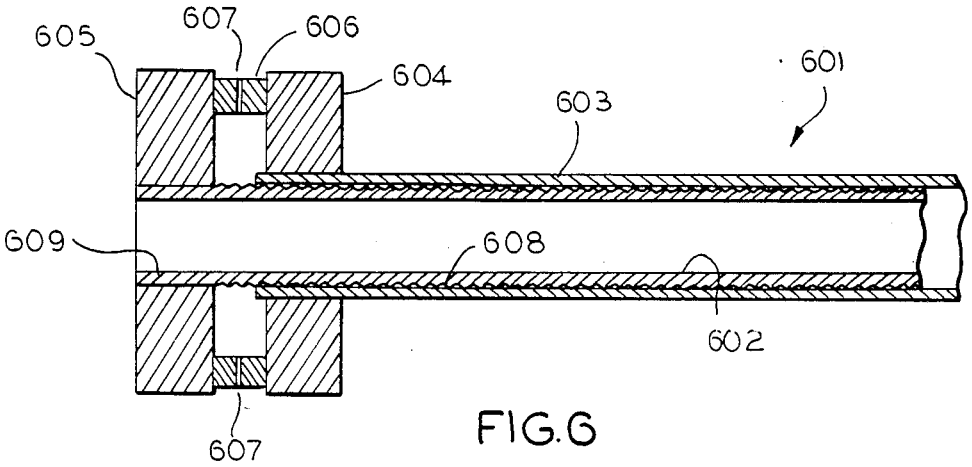
FIG. 6 illustrates the tube to tube sheet connection for one of the tubes in the heat exchanger of FIG. 5.

FIG. 6 illustrates the attachment of the heat transfer tubes to tube sheets. The heat transfer tube 601 has an inner tube 602 and outer tube 603. The outer tube 603 is attached to an outer tube sheet 604 and the inner tube is attached to an inner tube sheet 605. The inner and outer tube sheets are separated by a spacer ring 606 which has one or more vents 607. Inner tube 602 has an externallly knurled surface 608 except over end portion 609 where it is attached to inner tube sheet 605. The attachment of the inner and outer tubes 602, 603 to the tube sheets 605, 604 is accomplished by inserting a roller into inner tube 602 and roller expanding the inner tube so that a firm leak tight connection is established between outer tube 603 and outer tube sheet 604 and also between inner tube 602 and inner tube 605.

It should be noted that the amount of torque used in roller expanding the tubes must be carefully selected because if too much torque is used, the leak paths will be closed.

For the copper pipe used in the preceeding example, 30 to 35 inch pounds of torque was found to be sufficient. As can be seen in FIG. 6, the outer tube 603 extends beyond outer tube sheet 604 to assure a tight seal.

Figure 7:
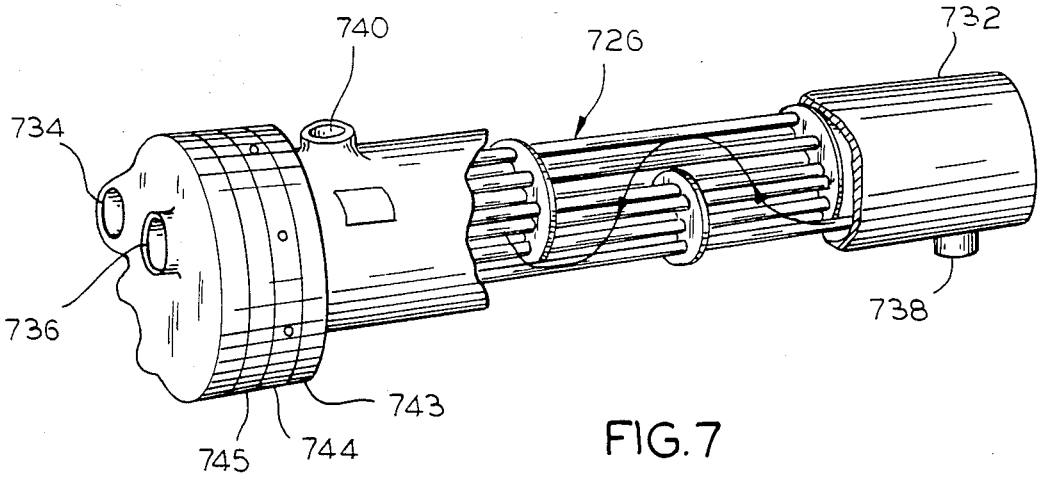
FIG. 7 illustrates a second heat exchanger in accordance with the invention.

FIG. 7 illustrates a hairpin type heat exchanger in accordance with the invention.

The heat exchanger includes a shell 732 having a plurality of heat transfer tubes 726 therein. Four ports are provided about the surface of shell 732. Ports 734 and 736 are respectively inlet and outlet ports for fluid flowing through the tubes 726. Ports 736 and 740 are respectively inlet and outlet ports for fluid flowing within shell 732 external to tubes 726 through a baffled flow indicated generally by arrow 742.

Shell 732 has a flange 743 which serves as an outer tube sheet, a vented steel spacer 744 and an inner tube sheet 745. Each of the tubes is formed as a hairpin as is well known. It has been found that acceptably small radius bends for the curved portion of the hairpins can be obtained utilizing a heat transfer tube having an inner tube with an externally knurled surface.

What is claimed is:

1. A heat exchanger comprising in combination:

at least one heat transfer tube, said heat transfer tube comprising an inner tube and an outer tube;

said inner tube having a knurled exterior surface, said knurled exterior surface being in contact with the interior surface of said external tube throughout the length of said outer tube and extending beyond said outer tube at each end, said knurled surface providing a plurality of interconnected leak paths, said outer tube having a relatively smooth external surface;

an outer tube sheet having an aperture receiving an end portion of said outer tube;

said outer tube being roller expanded into contact with said outer tube sheet;

an inner tube sheet spaced from said outer tube sheet;

said inner tube have first and second end portions with a smooth external surface beyond said extended knurled surface;

a spacer being positioned between said inner and outer tube sheets and around said extended knurled surface adjacent said first end portion, and said spacer having at least one vent hole; and said first inner tube smooth external end portion extending into an aperture of said inner tube sheet and being roller expanded into attachment to said inner tube sheet.

2. The combination of claim 1, wherein said heat transfer tube is a straight tube having said outer and inner tube sheets attached to one end; and said heat transfer tube having another outer and another inner tube sheet attached to the other end of said tube.

3. The combination of claim 1, wherein said heat transfer tube has a hairpin configuration, and said outer and inner tube sheets are attached to the ends of said tube.

4. The combination of claim 3, where said spacer is a steel spacer having a plurality of vent holes.

* * * * *